United States Patent [19]

Petty et al.

[11] Patent Number: 4,686,798

[45] Date of Patent: Aug. 18, 1987

[54] OPTICAL BLANK CARRIER FOR LATHING LENSES AND PROCESS THEREFOR

[75] Inventors: Dean M. Petty, Mesa; Howard M. Sage, Phoenix, both of Ariz.

[73] Assignee: Sola U.S.A. Inc., Phoenix, Ariz.

[21] Appl. No.: 747,484

[22] Filed: Jun. 21, 1985

[51] Int. Cl.[4] ..... B24B 41/06

[52] U.S. Cl. ..... 51/216 LP; 51/217 L; 51/284 R; 409/189; 409/276

[58] Field of Search ..... 51/216 LP, 284 R, 217 L, 51/277, 283 R, 284 E; 409/174, 183, 185, 189, 199, 276

[56] References Cited

U.S. PATENT DOCUMENTS

| | | | |
|---|---|---|---|
| Re. 19,015 | 12/1933 | Hill | 51/278 |
| 1,952,373 | 3/1934 | Hill | 51/216 |
| 2,304,984 | 7/1939 | Wood | 51/217 L |
| 2,585,287 | 2/1952 | Turner et al. | 51/216 LP |
| 3,030,859 | 4/1962 | Elliott | 88/54.5 |
| 3,032,936 | 5/1962 | Voice | 51/124 |
| 3,064,531 | 11/1962 | Bullock | 88/54.5 |
| 3,079,737 | 3/1963 | Kratt et al. | 51/217 L |
| 3,153,960 | 10/1964 | Allport | 51/217 L |
| 4,113,224 | 9/1978 | Clark et al. | 249/105 |
| 4,155,962 | 5/1979 | Neefe | 264/1 |
| 4,179,484 | 12/1979 | Neefe | 264/1 |
| 4,188,353 | 2/1980 | Neefe | 264/1 |
| 4,197,266 | 4/1980 | Clark et al. | 264/1 |
| 4,468,890 | 9/1984 | Nagaura | 51/3 |

*Primary Examiner*—Frederick R. Schmidt
*Assistant Examiner*—Bradley I. Vaught
*Attorney, Agent, or Firm*—Charles E. Cates; David A. Lowin

[57] ABSTRACT

A carrier is disclosed for supporting an optical blank in the chuck of a lathe, for machining the optical blank into a lens. The carrier has a substantially cylindrical body formed of a machinable material. The cylindrical body has an opening at a first end thereof through which an optical blank can be inserted, and a retaining portion for securing such optical blank in place. In a preferred embodiment, the retaining portion is an annular shoulder extending inwardly at a second end of the cylindrical body.

11 Claims, 9 Drawing Figures

OPTICAL BLANK CARRIER FOR LATHING LENSES AND PROCESS THEREFOR

BACKGROUND OF THE INVENTION

1. Field of the Invention

The present invention relates to a process and apparatus for the manufacture of hard and soft contact lenses, more particularly to a carrier for a polymer button. Specifically, the present invention relates to polymer button carrier which is itself machinable, for use during a lathing process in the manual or automated manufacture of a contact lens.

2. Background of the Invention

In the past, when manufacturing a contact lens from a polymer button, it has been necessary to mount, demount and re-mount the button onto carriers (or pins) for holding it in the lathes used to turn such buttons during cutting. For example, a representative process for manufacturing a contact lens by lathing of a polymer button can be described as follows.

A polymer button is mounted (e.g. using a blocking wax or the like) on a first metal (e.g. steel) pin. The pin is gripped in the chuck of a lathe, the pin/button assembly is rotated, and a cut is made in the exposed surface of the button. This cut becomes the posterior or base curve. Another cut is made into the side of the button, while the button is still rotating about the same axis as it rotated about during cutting of the base curve; this is a ledge cut and is called a base curve reference. The base curve is polished and the button is removed from the pin. The pin/button assembly is released from the chuck, the button is removed from the pin, and that surface of the button which was attached to the pin is cleaned (this will become the anterior surface of the lens). The center thickness of the button is measured (from the apex of the base curve to the nearest opposing uncut surface). The button is then re-mounted, this time by attaching the base curve to a second metal pin having a surface reciprocal to the base curve, taking care to allign the turning axis of the pin with the base curve reference. (This re-mounting step is subject to a high degree of error.) The second pin is gripped in the chuck of a lathe, the pin/button assembly is rotated, and a cut (or series of cuts) is made in the exposed surface of the polymer button; this forms the front curve(s) of the contact lens. The front surface is then polished. Next, the button is cut by removing an annular segment from it, to form the final diameter of the lens. The second pin/button assembly is then released from the chuck. The lens is removed from the second pin and cleaned of the blocking wax (or other attachment media) by physical and/or chemical methods known in the art. The edge of the lens is polished.

In the case of a hydrogel lens, the cut button (called a xerogel replica) is then hydrated, extracted, and placed in an appropriate solution and container for storage and sale.

The mounting, de-mounting and re-mounting process has been both time-consuming and inaccurate, and a particularly problematic part of prior contact lens manufacturing processes. One undesirable result of the inaccuracy inherent in mounting and remounting the button is the creation of undesired prism between the anterior and posterior surfaces of the finished lens. Another undesirable aspect of having to de-mount and re-mount the buttons is that this renders the lathing manufacturing process very difficult to automate.

The metal pins used in the above-described process are somewhat expensive and cannot, therefore, be treated as a disposable item. They must, therefore, be cleaned (another time-consuming and expensive process) and reused, in order to maintain reasonable manufacturing costs. Another undesirable attribute of using metal pins is that, on occasion, when a cutting tool (usually an expensive diamond tipped tool) is moved too far through the button, the tool digs into the pin, destroying both the pin and itself.

In one previous attempt to simplify such processes, described in U.S. Pat. No. 3,046,531 to Bullock, a button carrier is provided with a threaded inner surface and a reciprocally threaded surface is cut into a button. The button is then threaded into the carrier for making a first cut on one surface. It is then removed from the carrier, inverted, and re-inserted (by screwing it into the carrier) for the cuts on the other surface. This did not eliminate the demounting and remounting steps identified above as a problem, nor did it assure the absence of prism, as the re-insertion of the lens does not guarantee alignment of the button on the same axis of rotation for cutting the second surface. Some other methods of mounting and forming contact lenses are described in U.S. Pat. Nos. 3,030,859; 3,032,936; and Re. 19,015.

It is an object of the present invention to eliminate the need for mounting and re-mounting the polymer button onto carriers during the contact lens manufacturing process.

Another object of the present invention is to provide a contact lens which has absolutely no appreciable prism between its anterior and posterior curves. A related object of the present invention is to provide a contact lens having a precisely controlled prismatic component between its anterior and posterior surfaces.

Still another object of the present invention is to provide a contact lens in accordance with the foregoing objects which is easier, quicker and less expensive to manufacture.

Yet another object of the present invention is to provide a contact lens having an edge, the thickness of which is uniform to within ±0.01 mm throughout.

A still further object of the invention is to provide a carrier for a polymer button which is susceptible to being used in a fully automated process for the manufacture of contact lenses, without need for de-mounting and re-mounting the button between the cutting steps for the anterior and posterior surfaces.

A further object of the invention is to provide a button carrier in accordance with the foregoing objects which is both inexpensive to manufacture and, therefore, disposable.

Another object of the present invention is to provide a button carrier which will not damage the tool used to cut the polymer button in the event of accidental contact between that tool and the button carrier.

SUMMARY OF THE INVENTION

A carrier is disclosed for supporting an optical blank in the chuck of a lathe, for machining the optical blank into a lens. The carrier has a body formed of a machinable material. The body has an opening through which an optical blank can be inserted, and a retaining portion for securing such optical blank in place. In a preferred embodiment, the body is cylindrical and the retaining portion is an annular shoulder extending inwardly at an end of the body opposite the opening. The carrier preferably has: a substantially cylindrical first, retaining portion; a larger diameter, substantially cylindrical, second portion; and a conical third portion therebetween.

In another aspect, the invention discloses a process for manufacturing a lens from an optical blank, including the steps of:

(a) securing the optical blank to an inside wall of a carrier,
(b) gripping the carrier in a rotation means and rotating the carrier/blank assembly,
(c) forming an optical curve on a first surface of the optical blank,
(d) placing a supporting substance inside the carrier in contact with the blank, on the side of its first surface, and in contact with the adjacent inner wall of the carrier,
(e) rotating the carrier,
(f) forming an optical curve on a second surface of the optical blank by cutting through a portion of the carrier wall and removing a portion of the second surface,
(g) removing an annular portion of the optical blank to form the circumference of the lens, and
(h) removing the optical blank from the carrier.

BRIEF DESCRIPTION OF THE DRAWINGS

The invention will now be described with reference to the attached sheets of drawing, in which.

DETAILED DESCRIPTION OF THE PREFERRED EMBODIMENTS

Figure 1:
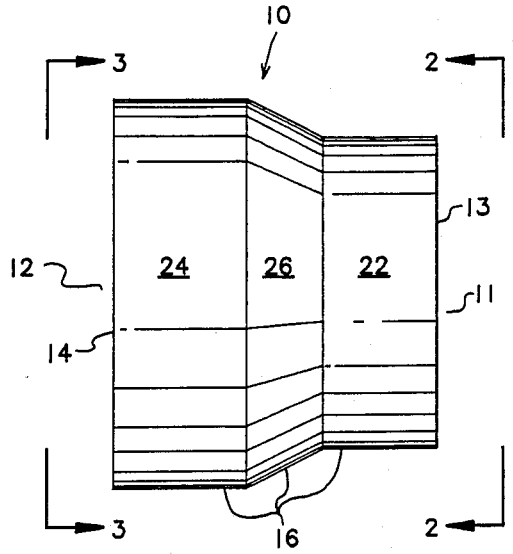
FIG. 1 is a side plan view of a button carrier embodying the principles of the present invention, shown enlarged for ease of illustration.
Figure 2:
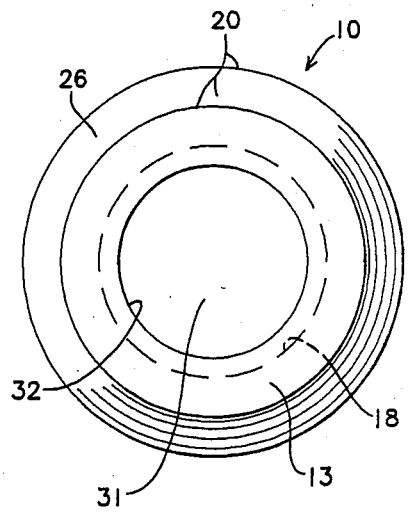
FIG. 2 is an end plan view of the button carrier of FIG. 1, taken along line 2—2 in FIG. 1.
Figure 3:
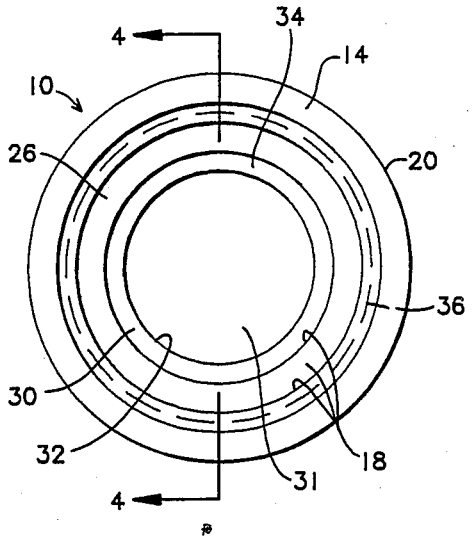
FIG. 3 is a plan view of the other end of the button carrier of FIG. 1, taken along line 3—3 in FIG. 1.
Figure 4:
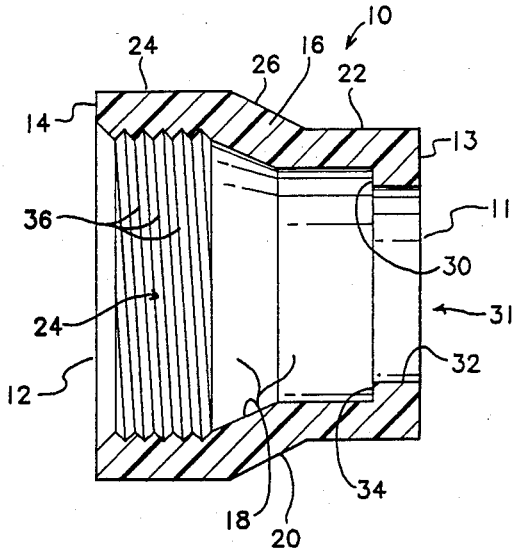
FIG. 4 is a cross-sectional view of a button carrier embodying the principles of the present invention, taken along line 4—4 in FIG. 3.
Figure 5:
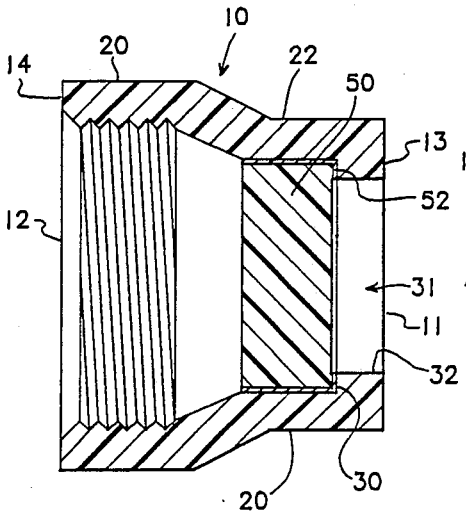
FIG. 5 is a cross-sectional view of a button carrier embodying the principles of the present invention, similar to the view shown in FIG. 4, illustrating a polymer button inserted into the button carrier.
Figure 6:
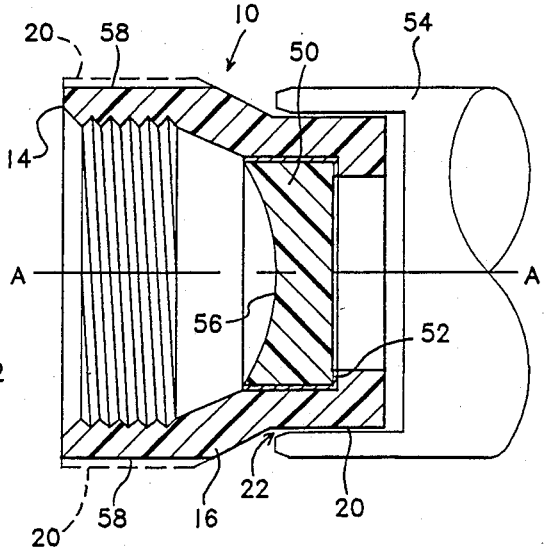
FIG. 6 is another view of the carrier/button assembly of FIG. 5, shown mounted in a chuck with a base curve cut into the button and a mounting surface cut into the button carrier.
Figure 7:
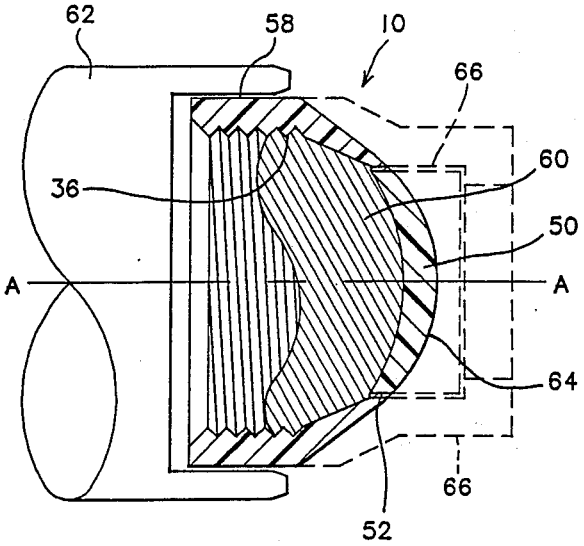
FIG. 7 is another view of the carrier/button assembly of FIG. 6, shown mounted in a chuck with a front curve cut into the button and extending into the button carrier.
Figure 8:
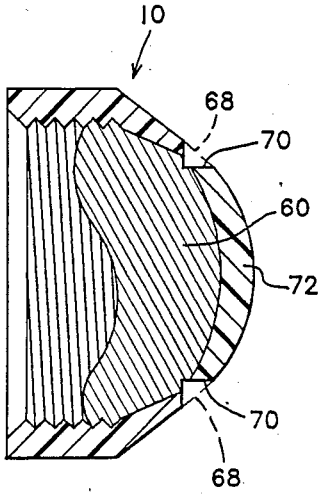
FIG. 8 is another view of the carrier/button assembly of FIG. 7, shown with an annular portion removed from the circumference of the lathed button to form the final diameter of a contact lens or replica.

Referring to FIGS. 1-4, a button carrier 10 has a first end 11 and a second end 12 defining end walls 13 and 14 respectively, connected together by a wall 16 having an inner surface 18 and an outer surface 20. The button carrier 10 has a first portion 22 (adapted for receiving an optical blank, such as a polymer button for making a contact lens) and a second portion 24.

In the illustrated, presently preferred embodiment: the button carrier is generally cylindrical; the second portion 24 has a diameter greater than that of the first portion 22; the two portions 22 and 24 are connected together by a conical third portion 26; and the second portion 24 has a series of threads 36 on its inner surface 18.

An inwardly extending shoulder 30 is disposed towards first end 11 of the button carrier, resulting in an opening 31. The shoulder 30 can be described as a thickening of the cylindrical wall 16 towards first end 11 to present a smaller diameter inner surface 32 and a connecting inner end wall 34. In an optional embodiment (not illustrated in the figures) the first end wall 13 may be solid, replacing the flange or shoulder 30. However, as will be apparent with reference to the process of the invention, if end wall 13 is solid, other means (e.g. an automated lathe) must be used to measure the optical blank's center thickness after the base curve has been cut.

The button carrier is fabricated of a somewhat rigid, dimensionally stable material that can be machined by lathing. Preferably, the selected material will not interact adversely with the polymers from which contact lenses are typically made, nor with the waxes and like adhesives used in contact lens manufacturing processes. For example, the button carrier may be fabricated of plastic (e.g. acrylic plastics), wood, or soft metal. The button carrier is preferably fabricated as a molded plastic part made, for example from polyethylene, polypropylene, polymethyl methacrylate or the like.

A process for the manufacture of a lens by lathing a polymer button (or optical blank) held in the carrier of the present invention will be described with reference to FIGS. 5-8. It should be noted that the sequence of steps described in this paragraph may be varied, for example to adapt the process for automation.

A polymer button 50 is inserted into a button carrier 10 through end 12 and retained in first portion 22 adjacent shoulder 30 by retaining means 52, such as an adhesive (e.g. blocking wax). The conical third portion 16 facilitates locating the polymer blank in place. The carrier/button assembly is gripped in a chuck 54 of a lathe, and rotated about an axis passing approximately through the center of the button and the hollow center of the button carrier (shown as line A—A in FIGS. 6 and 7). The first end 11 of the carrier/button assembly is inserted into a chuck 54 and gripped along outer surface 20 of cylindrical wall 16 of the first portion 22. Alternatively, an expanding gripping mechanism can be inserted into the smaller inner diameter surface 32 of flange 30 or other gripping methods may be used to hold the assembly for rotation.

A cutting tool (not shown) is inserted through open end 12 of the button carrier and contacted with the polymer button 50 to form a posterior or base curve 56. Second portion 24, when formed with a diameter greater than first portion 22 (and the button), may better accomodate such cutting tool. Still turning the carrier/button assembly about axis of rotation A—A, a reference/mounting surface 58 (having line A—A as its central axis), for grasping the carrier in the chuck of a lathe, is cut into the outer surface 20 of cylindrical wall 16 in second portion 24 of the button carrier (removing the portion shown in dashed line in FIG. 6). This new diameter provides a reference/mounting surface 58 which is concentric with the base curve and perpendicular to the chordal plane of the base curve, and which is exactly concentric with the axis of rotation about which the base curve was cut. Reference/mounting surface 58 thereby allows the button to be rotated about axis A—A for subsequent cutting operations, i.e. to form the anterior surface of the lens with precise accuracy relative to the posterior surface. The carrier/button assembly is then released from the chuck 54.

The center thickness of the button 50 is measured (from the apex of the base curve to the nearest opposing uncut surface). One method of making this measurement involves inserting a thickness gauge through the two open ends 11 (opening 31) and 12, to make contact with the button's surfaces. The carrier/button assembly is then filled (either partially or wholly) through the opening at end 12 with a supporting means 60 which may be the same or different from the adhesive means 52. The support fills the third portion 26 and at least part of the second portion 24 of the button carrier 10. The threads 36 function to help retain the support 60 in place within the carrier. The supporting means 60 holds the partially machined button securely for subsequent machining operations. The carrier/button assembly is then gripped in a chuck 62 of a turning lathe along the outer surface 20 of wall 16 of the second portion 24, i.e. reference/mounting surface 58.

The carrier/button assembly is then rotated about axis A—A (the identical axis of rotation used to form the base curve 56). A cutting tool (not shown) is brought across the assembly towards its first end 11 to remove a portion (shown as dotted line 66 in FIG. 7) of both the carrier and the button, thereby forming a front surface 64 on the button 50. The front optical curve or curves of the contact lens to be produced may be formed by making one or more cuts on this front surface. The front surface is then polished.

Next, turning the carrier/button assebly about axis A—A, an annular segment (shown in dotted line as reference numeral 68) is removed from the outer periphery of the button 50, to cut the button to the final diameter of the contact lens or xerogel replica of this process, forming its outer edge 70. The button carrier is released from the chuck 62. The xerogel replica or lens 72 held thereon is removed from the supporting means 60 and cleaned of that adhesive by physical and/or chemical means well known in the art. The edge of the lens or xerogel replica 72 is then polished.

In the case of a xerogel replica, the replica is then hydrated, extracted and placed in an appropriate solution and container for storage and sale, all of which are well known in the art.

If it is desired to introduce a prismatic component into the lens, the axis of rotation can be changed for the cutting of the front surface, or the angle of the cutting tool can be changed. The degree of prism can be accurately maintained because of the ability to precisely set the rotational axis.

Thus, the button carrier of the present invention satisfies all of the objects stated above.

Figure 9:
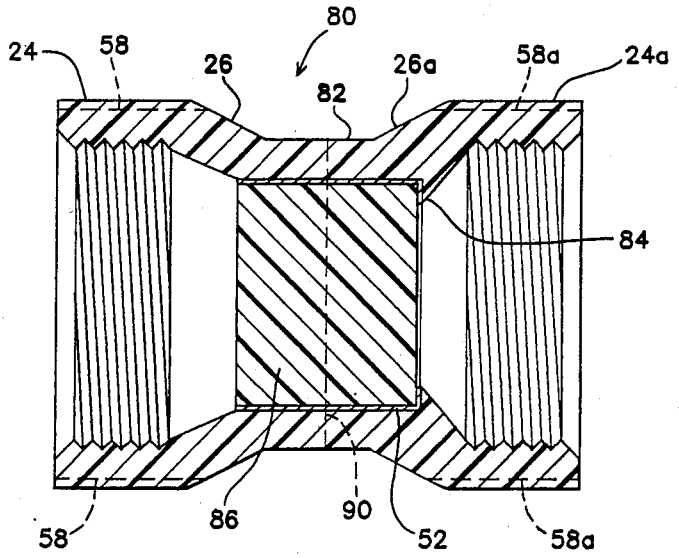
FIG. 9 is a cross-sectional view of another embodiment of a carrier/button assembly embodying the principles of the present invention, adapted for making two lenses from a single button.

Another embodiment of a button carrier of the present invention is adapted for the manufacture of two contact lenses from a single button; this embodiment is illustrated by reference numeral 80 in FIG. 9. The button carrier 80 can best be described as a pair of the button carriers 10 of the above-described embodiment joined together at end 11. A first portion 82 (somewhat elongated as compared to the first embodiment 10) is provided with a flange or shoulder 84, disposed at one end, against which to secure a button 86 (the button may be somewhat thicker than the button 50 employed with the first embodiment 10). The button can, alternatively, be held in place using only adhesive as the retaining means (i.e. with no shoulder 84). The carrier 80 has a pair of second portions 24 and **24*a* and a pair of third portions 26 and 26*a***.

In use, the button 86 is inserted into the carrier 80 and held in place by retaining means 52. The carrier is grasped for rotation. It may be grasped about first portion 82 to expose both sides of the button for cutting of base curves therein. Alternatively, carrier 80 may be grasped about second portion 24 to cut a base curve in a first exposed side of the button and to cut a mounting surface **58*a* into second portion 24*a*, and then grasped about second portion 24*a* to cut a base curve into the other side and a reference/mounting surface 58 into second portion 24 (illustrated by dashed lines 58 and 58*a*). The inside of the carrier is filled with adhesive material, as previously described, and the carrier is then cut in half, dividing it approximately across the center of the button 86 (e.g. along dashed line 90**). The two halves are then treated as described above.

To those skilled in the art to which this invention relates, many changes in construction and widely differing embodiments and applications of the invention will suggest themselves without departing from the spirit and scope of the invention. For example, the button carrier and method of the present invention can be used for holding optical blanks in cutting operations not limited to the manufacture of contact lenses, e.g. for microscope, telescope and camera lenses. Likewise, the carrier can be provided with a shoulder at any selected point of its inner wall so that the optical blank can be held at any given point within the carrier, depending upon the kind of lens being made and the process chosen for making it. The disclosure and the description herein are purely illustrative and are not intended to be in any sense limiting.

What is claimed is:

1. A lens preparation system including:

(A) a carrier reversibly mountable in a turning lathe chuck and subject to be machined coaxially with an axis of rotation of a chuck in which it is mounted, said carrier being adapted to support an optical blank during the process of machining both faces of the optical blank with the turning lathe to form a lens having a posterior curve and an anterior curve without the necessity for removing the optical blank from said carrier intermediate the machining process, said carrier comprising:

(1) a one-piece body formed from a material which has machining characteristics similar to the machining characteristics of the material from which the optical blank is formed; said body having:

(a) a first end;

(b) a second end;

(c) an outer surface; and (d) an opening therethrough extending between said first and second ends and defining an inner surface;

(2) blank positioning means proximate said second end for accepting and defining the position of an optical blank inserted into said body through said first end; and (3) first retaining means for securing the optical blank within said body at said blank positioning means during the process of machining the posterior curve from the optical blank;

(B) means extending into said opening from said first carrier end for machining a posterior curve from a first face of the optical blank while it is mounted in said carrier and said carrier is mounted in a first turning lathe chuck;

(C) means for machining a reference/mounting surface from said outer surface such that said reference/mounting surface is coaxial with the axis of said posterior curve;

(D) second retaining means introduced into said opening at said first end after said posterior curve has been machined, said second retaining means being adapted to fix the position of said lens blank by engaging and juxtaposing said posterior curve and said inner surface;

(E) means for subsequently mounting said carrier in a second turning lathe chuck, said second turning lathe chuck engaging said reference/mounting surface; and (F) means for thereafter concurrently machining an anterior curve from a second face of the optical blank and at least a portion of said carrier contiguous with said optical blank such that the axis of said anterior curve is coaxial with said reference/-mounting surface.

2. The lens preparation system of claim 1 in which said first retaining means comprises an inwardly extending shoulder disposed at said second end of said body and an adhesive disposed against said inner surface and shoulder for contacting the optical blank.

3. The lens preparation system of claim 1 in which a portion of said inner surface disposed towards said first end is threaded.

4. The lens preparation system of claim 3 in which said second retaining means is an adhesive mass in contact with said posterior curve and said inner surface threaded portion.

5. The lens preparation system of claim 1 in which said carrier is formed of an acrylic plastic.

6. The lens preparation system of claim 1 in which said carrier further comprises:

(A) a first portion of said body disposed adjacent said first end;

(B) a second portion of said body disposed opposite said first end, said second portion being adapted to securely receive the optical blank; the inside diameter of said first portion being larger than the inside diameter of said second portion; and (C) a third portion of said body joining said first portion and said second portion.

7. The lens preparation system of claim 5 in which said first retaining means comprises an inwardly extending shoulder disposed at said second end of said body and an adhesive disposed against said inner surface of said second portion and against said shoulder for contacting the optical blank.

8. The lens preparation system of claim 5 in which a portion of said inner surface of said first portion disposed towards said third portion of said body is threaded.

9. The lens preparation system of claim 7 in which said second retaining means is an adhesive mass in contact with said posterior curve and said inner surface threaded portion.

10. The lens preparation system of claim 6 in which said carrier is formed of an acrylic plastic.

11. A lens preparation system for preparing two lenses including: a double carrier reversibly mountable in a turning lathe chuck and subject to being machined coaxially with an axis of rotation of a chuck in which it is mounted, said carrier being adapted to support a double optical blank during the process of machining both faces of the double optical blank with the turning lathe to form a modified double lens blank having two posterior curves and for subsequent bifurcation with said modified double optical blank to obtain a pair of single carriers, each said single carrier being reversibly mountable in a turning lathe chuck and subject to being machined coaxially with an axis of rotation of a chuck in which it is mounted, each said single carrier being adapted to support a single optical blank, obtained by the bifurcation of the double optical blank, during the process of machining a second face of the single optical blank with the turning lathe to form a lens anterior curve without the necessity for removing the single optical blank from its said carrier intermediate the machining process;

(A) said double carrier comprising:

(1) a one-piece body formed from a material which has machining characteristics similar to the machining characteristics of the material from which the double optical blank is formed, said double carrier body having:

(a) a first end;

(b) a second end;

(c) an outer surface; and (d) an opening therethrough extending between said first and second ends and defining an inner surface;

(2) means for inserting the double optical blank into said body to an intermediate position;

(3) first retaining means for fixing the double optical blank at said intermediate position;

(4) means for inserting a cutting tool into said opening from said first end to machine a first exposed surface of the double optical blank in a first posterior curve;

(5) means for machining a first reference/mounting surface from said outer surface proximate said first end of said double carrier such that said first reference/mounting surface is coaxial with the axis of said first posterior curve;

(6) means for inserting a cutting tool into said opening from said second end to machine a second exposed surface of the double optical blank in a second posterior curve; and (7) means for machining a second reference/-mounting surface from said outer surface proximate said second end of said double carrier such that said second reference/mounting surface is coaxial with the axis of said second posterior curve;

(B) means for concurrently parting said double carrier and said modified double optical blank at said intermediate position to obtain a pair of single carriers, each said single carrier supporting a single optical blank for which the posterior curve has been machined;

(C) each said single carrier comprising a one-piece body, said body having a first end and a second end, said single optical blank being situated at said second end;

(D) second retaining means introduced into said opening at said second end of said single carrier, said second retaining means being adapted to fix the position of said single lens blank by engaging and juxtaposing said posterior curve thereof and said inner surface; and (E) means for thereafter concurrently machining an anterior curve from a second face of the single optical blank and at least a portion of said single carrier contiguous with said single optical blank such that the axis of said anterior curve is coaxial with said reference/mounting surface thereof.

* * * * *